United States Patent [19]

Sleichter, III et al.

[11] Patent Number: 4,852,874

[45] Date of Patent: Aug. 1, 1989

[54] PORTABLE ISOKINETIC EXERCISING DEVICE

[75] Inventors: Charles G. Sleichter, III, San Juan Capistrano; Don G. Danks, Newport Beach, both of Calif.; Dale Strong, Carberry, Canada

[73] Assignee: Advantage Entertainment, Inc., Costa Mesa, Calif.

[21] Appl. No.: 229,220

[22] Filed: Aug. 5, 1988

Related U.S. Application Data

[63] Continuation-in-part of Ser. No. 100,362, Sep. 23, 1987, abandoned.

[51] Int. Cl.[4] ..... A63B 21/02

[52] U.S. Cl. ..... 272/137; 272/143; 272/136

[58] Field of Search ..... 272/135–139, 272/142, 143

[56] References Cited

U.S. PATENT DOCUMENTS

| | | | |
|---|---|---|---|
| 2,118,114 | 5/1938 | Schenk | 272/142 |
| 2,224,103 | 12/1940 | Nilson | 272/137 |
| 3,529,820 | 9/1970 | Templeton | 272/137 |
| 3,951,404 | 4/1976 | Brown | 272/142 |
| 4,090,706 | 5/1978 | Reda | 272/137 |
| 4,328,964 | 5/1982 | Walls | 272/142 |
| 4,463,948 | 8/1984 | Mohr | 272/142 |

FOREIGN PATENT DOCUMENTS

| | | | |
|---|---|---|---|
| 1249617 | 11/1960 | France | 272/137 |

*Primary Examiner*—Richard J. Apley
*Assistant Examiner*—J. Welsh
*Attorney, Agent, or Firm*—John E. Reilly

[57] ABSTRACT

An exercise device comprises an elastic loop having free ends spliced together, generally tubular handles disposed in diametrically opposed relation to one another on the loop and an elastic retainer sleeve surrounding intermediate portions of the loop between the handles. The device is conformable for use in performing a wide variety of exercises and for performing a selected number of repetitions of each exercise by grasping the handles and stretching against the resistance load of the loop and the retainer means. The handles can be grasped either by the hands or by a combination of hands and feet to perform various exercises or may be grasped between the feet or ankle portions to perform other exercises. In modified forms of the invention, one of the handles is made rigid so as to simulate a racquet or golf club handle to be used in practicing forehand and backhand strokes or to simulate the golf swing. The exercises may be performed effectively in either the standing, sitting or fully prone position. Other modified forms of invention include an anchor strap to facilitate practicing of the golf swing and a splice for joining together free ends of the loop into a unitary member.

13 Claims, 4 Drawing Sheets

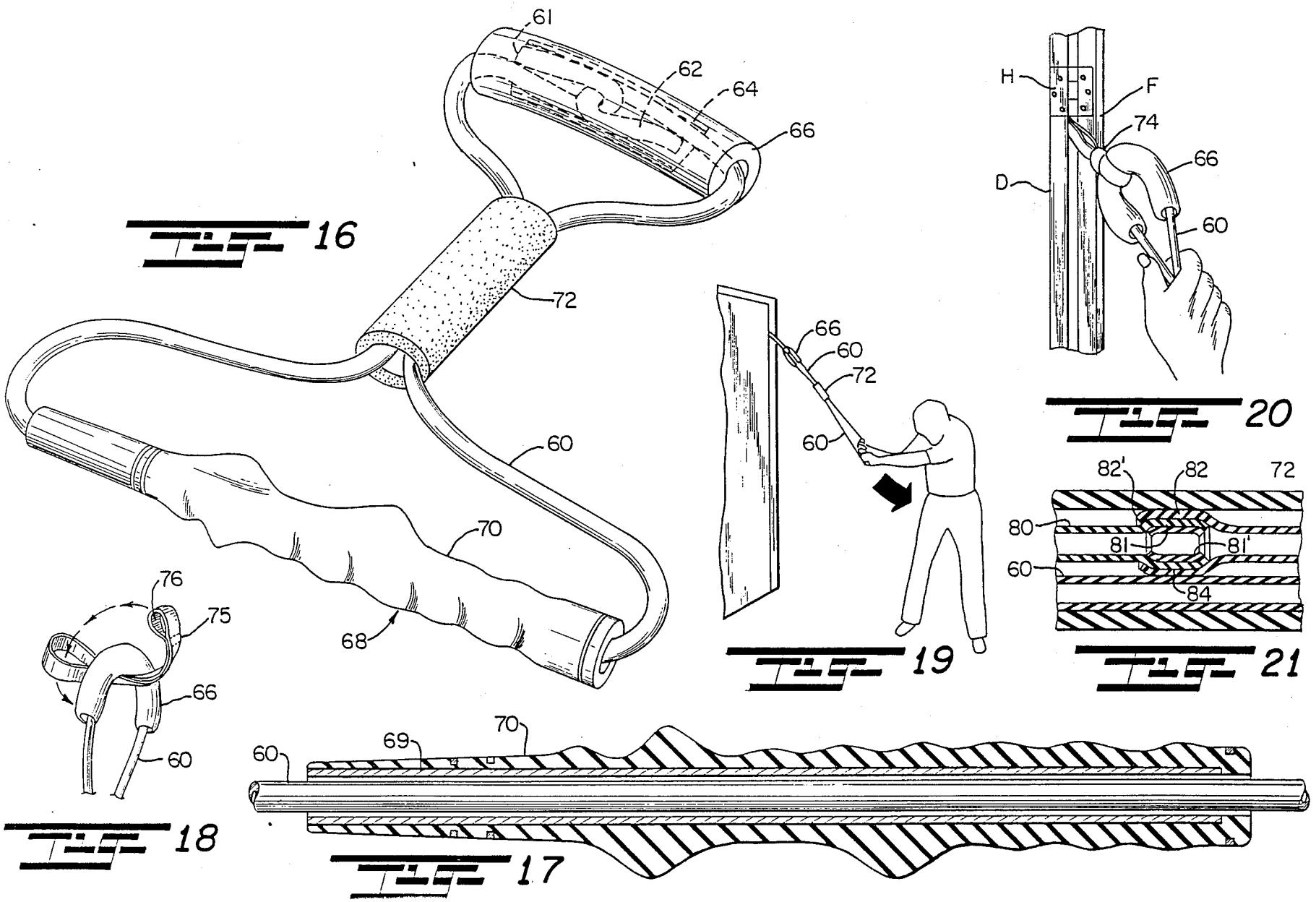
61
62
64
66
72
60
70
68
16
66
60
72
66
60
19
72
82
81'
84
82'
81
80
60
21
F
74
66
60
H
D
20
75
66
76
60
18
70
69
60
17

PORTABLE ISOKINETIC EXERCISING DEVICE

This application is a continuation-in-part of Ser. No. 100,362, filed Sept. 23, 1987 and entitled "Portable Isokinetic Exercising Device", now abandoned.

This invention relates to exercise devices; and more particularly relates to a novel and improved generally loop-shaped, portable exercise device which can be manually operated to perform various different conditioning exercises without assembly or reconfiguration.

BACKGROUND AND FIELD OF THE INVENTION

Numerous muscle conditioning or toner devices have been devised as an aid in the performance of different exercise routines. For example, it is customary to employ one or more coiled spring elements or elastic straps with rigid handle grips which will impose a predetermined degree of resistance when stretched by the hands or legs or a combination of the two. However, conventional types of hand-held exercising devices have definite limitations, especially those which require contact with the body, since often the spring members are abrasive and tend to cause chafing when brought into contact with the skin and may cause injury if misuse or breakage occurs. Also conventional devices of the type described are further limited somewhat with respect to the types and number of exercises that may be performed and the number of muscle groups affected.

Generally loop-type elastomeric bands have been employed in the past and which are so constructed as to include handle grips at diametrically opposed portions of the loop. It is important that the loop portions between the handle grips be covered or joined in such a way as to avoid chafing when moved into contact with the skin but nevertheless be free to stretch along their axes. At the same time it is highly desirable that the exercise device be capable of accommodating grips which will simulate exercising for the racquet games as well as for golf; and a splice which will assure positive connection of the free ends of the exercise device so as to avoid accidental separation or loosening at the connected free ends of the loop.

SUMMARY OF THE INVENTION

Accordingly, it is an object of the present invention to provide for a novel and improved exercise device which is highly versatile and capable of being used in performing a wide variety of exercises, conditioning all major muscle groups for general muscle tone including muscle tone specific to golf and racquet sports.

Another object of the present invention is to provide for a novel and improved hand-held exercise device which is extremely lightweight, compact and of durable construction.

It is a further object of the present invention to provide for a novel and improved hand-held exercise device comprised of a minimum number of parts which can be easily assembled and used to perform a wide variety of exercises; and further wherein the device is so constructed and arranged as to minimize any chafing or pinching when performing exercise routines that require contact with the skin and may be used while standing, sitting or in a prone position.

A further object of the present invention is to provide for a novel and improved exercise device in which handle grip members are employed in combination with an endless loop to create a predetermined modulus of elasticity and resistance in performing different stretching exercises and further wherein the device is conformable for use in performing both stretching and squeezing exercises.

A still further object of the present invention is to provide for an exercise device capable of being utilized in simulating the racquet sports or golf in which one end of the device may be securely anchored and the opposite end gripped in one or both hands to simulate different exercises; and further wherein a novel and improved splice has been deviced for use in connecting free ends of a loop-type exercise device.

In accordance with the present invention, a preferred form of exercise device comprises an elastic member in the form of an endless loop, a pair of flexible handles disposed on the loop in diametrically opposed relation to one another and in surrounding relation to the loop, and elastic retainer means joining portions of the endless loop intermediately between the handles, the retainer means joining those portions so as to yieldingly resist separation of the joined portions of the loop in response to grasping of the handles and stretching of the loop between the handles. The loop is given a predetermined modulus of elasticity to resist stretching, and the handles are preferably in the form of flexible sleeves which to some extent will resist stretching forces applied by the user. Elastic retainer means preferably takes the form of a sleeve or band surrounding the diametrically opposed portions of the loop between the handle so as to prevent chafing of the skin but at the same time not interfere with stretching of the individual loop portions either in a longitudinal or circumferential direction.

The preferred form of exercise device is conformable for use in performing a wide variety of exercises involving all major muscle groups. It is specifically designed for performing a number of repetitions of each exercise by grasping the handle portions and stretching the loop to cause an increasing resistance load on the working muscle groups. The handles can be grasped either by the hands to perform different exercises which require stretching of the loop across the chest, back or over the head as well as by a combination of hands and feet to perform arm curls, side bends, squats, sitting-rowing, or back conditioning; or can be grasped between the feet or ankle portions to perform leg curls and lateral leg raise exercises.

In a modified form of invention, one of the handles of the preferred form of invention is a rigid handle grip so as to effectively simulate either a racquet handle or a golf club grip. The racquet handle can be employed to practice and to build up that set of muscles used in performing forehand, backhand, service and volley strokes. Similarly, the golf swing is simulated by placing the flexible handle beneath the front foot and grasping the golf grip with both hands to practice the backswing against the resistance of the exercise device. The downswing may be practiced in the same manner by placing the flexible handle around the back foot and swinging through against the resistance of the exercise device.

Still another modified form of exercise device incorporates a novel and improved splice for joining free ends of the loop into a unitary element and in such a way that the splice can be covered either by a retainer sleeve or handle grip portion. The splice is so constructed and arranged as to be adaptable for use in combination with an anchor strap to facilitate anchoring of one end of the exercise device to a stationary object when the user desires to simulate different swinging movements, such as, associated with golf and with racquet sports.

The above and other objects of the present invention will become more readily appreciated and understood from a consideration of the following detailed description of a preferred embodiment when taken together with the accompanying drawings wherein:

BRIEF DESCRIPTION OF THE DRAWINGS

FIG. 16 is a perspective view of another modified form of invention utilizing a golf club grip at one end of the device;

FIG. 17 is a cross-sectional view enlarged of the golf club grip and its mounting on the exercise device;

FIG. 18 illustrates one end of the exercise device of FIG. 16 with an anchor strap at the flexible end portion of the device;

FIG. 19 illustrates a simulation of the golf swing with the modified form of exercise device of FIG. 16;

FIG. 20 is a view in more detail illustrating the anchoring of the end of the exercise device as shown in FIG. 19; and FIG. 21 is a sectional view of an alternate form of splice for connecting free ends of the exercise device as illustrated in FIGS. 1 to 20.

DETAILED DESCRIPTION OF THE PREFERRED EMBODIMENT

Referring in more detail to the drawings, there is illustrated in FIGS. 1 to 4 a preferred form of exercising device 10 which is broadly comprised of an elastic endless loop 12, a pair of tubular handles 14 and 15, and a retainer sleeve or band 16 in surrounding relation to intermediate portions of the loop between the handles 14 and 15.

Figure 2:
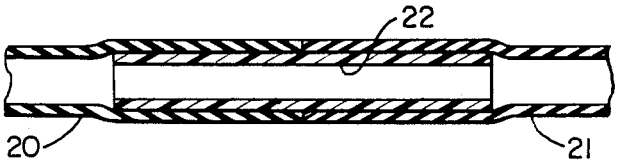
FIG. 2 is a sectional view enlarged through the spliced connecting end portions of the loop.
Figure 3:
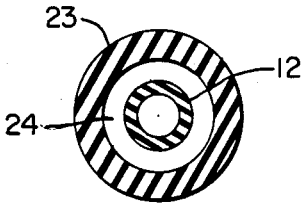
FIG. 3 is a cross-sectional view taken about lines 3—3 of FIG. 1.

Considering in more detail the construction and arrangement of the preferred form of exercising device, the loop 12 is preferably composed of a latex material and is of tubular cross-section which may be of varying wall thickness depending upon the modulus of elasticity and stretch resistance desired. The loop is formed from a length of tubing which may, for example, be between 36" and 42" depending upon user requirements. For example, the length would be greater for adult males than for females or for youngsters and the same would be true for the degree of stretch resistance designed into the loop itself. The tubing length terminates in free ends 20 and 21 which as best seen from FIG. 2 are spliced together by a coupling 22 in the form of a tubular insert, and a suitable bonding agent or adhesive may be applied between the contacting wall surfaces of the ends 20, 21 and the insert 22 in order to securely splice the free ends of the tubing together to form an endless loop. The insert 22 may be suitably formed of a polyvinyl tubing which possesses some flexibility so as to be capable of bending with the loop along the spliced end portion.

Each of the handle members 14 and 15 is correspondingly made up a flexible sleeve which is dimensioned to loosely surround the loop 12. In other words, the inner diameter of the sleeve is preferably of a size or circumference so as to leave a slight spacing or gap 24 between the sleeve 23 and loop 12. Each sleeve is similarly composed of a rubber or rubber-like material which possesses some resilience and flexibility so as to follow the contour of the loop and be capable of being squeezed or compressed when gripped in the hand. Preferably, each sleeve 23 is of a length of approximately one-eighth of the length of the loop and each is assembled onto the loop prior to splicing of the ends 20 and 21. Once the ends 20 and 21 are spliced together, the handles are then positioned such that one handle 15 is disposed over the spliced end portion of the loop while the other handle 14 is disposed in diametrically opposed relation to the handle 15 at the opposite end of the loop.

Figure 1:
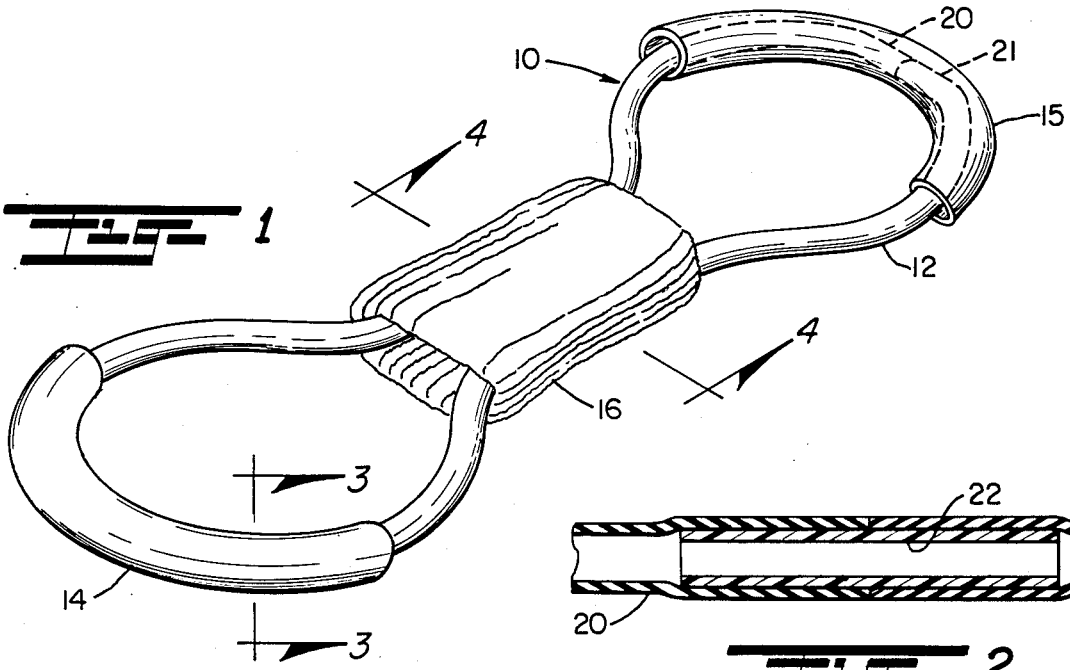
FIG. 1 is a perspective view of a preferred form of aerobic exercising device in accordance with the present invention.
Figure 4:
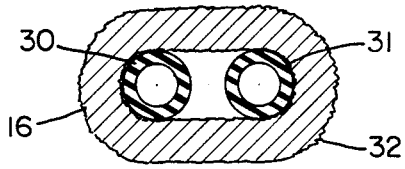
FIG. 4 is a cross-sectional view taken about lines 4—4 of FIG. 1.

The preferred form of retainer band or sleeve 16 is similarly of tubular cross-section but of a greater diameter than that of the handles and such that it will circumscribe a pair of the looped portions in closely spaced juxtaposed relation to one another, as illustrated in FIG. 4. Thus as shown in FIG. 4, loop portions 30 and 31 which are disposed intermediately between the handles 14 and 15 are brought into close proximity to one another by the retainer band 16. The retainer band 16 is preferably composed of an elastic material covered with a terry cloth material 32 which is also capable of stretching or expanding in a radial direction normal to the length of the loop 12. In other words, when the handles are grasped by the user and a stretching force applied in the direction of the length of the loop as shown in FIG. 1, the intermediate loop portions will tend to undergo transverse spreading or movement away from one another so as to cause the sleeve 16 to expand to some degree. An important feature of the retainer sleeve 16 is that it will protect the skin against abrasion or pinching, for example, when exercises are performed which bring the loop into contact with the skin.

Figure 5:
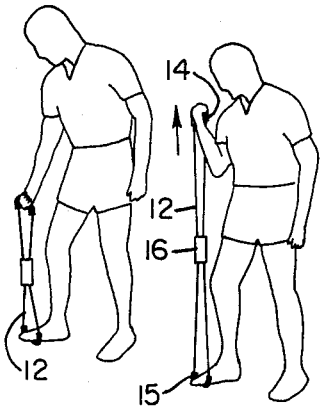
FIGS. 5, 6, 7, 8 and 9 schematically illustrate typical exercises which can be performed with the device of the present invention.

For the purpose of illustration but not limitation, FIGS. 5 to 9 illustrate typical exercises which may be carried out with the exerciser of the present invention. For example, as illustrated in FIG. 5, arm or wrist curls may be performed by passing one foot through one end of the loop and over a handle portion and grasping the other handle member in the hand and repetitively raising the hand from the lower extended position to the raised position as shown in the right hand view of FIG. 5.

Figure 6:
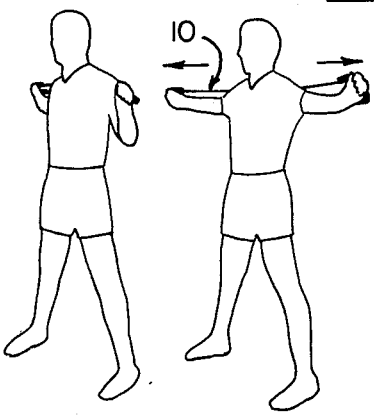

FIG. 6 illustrates use of the device 10 by grasping a handle portion in each hand and placing the device 10 across the upper back and repetitively stretching the arms between the bent position shown in the lefthand view and the extended position shown in the righthand view of FIG. 6.

Figure 7:
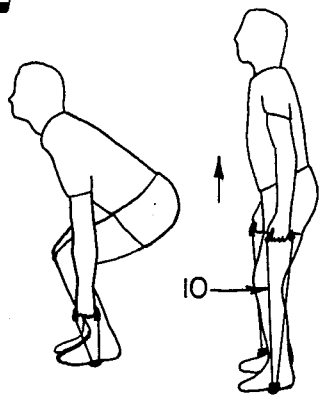

FIG. 7 illustrates use of the exercise device 10 in performing leg squats and wherein the exercise device 10 is placed beneath the feet and the handles grasped in the hands on opposite sides of the legs and undergoing a series of squats between the bent position shown in the lefthand view and the extended or raised position shown in the righthand view.

Figure 8:
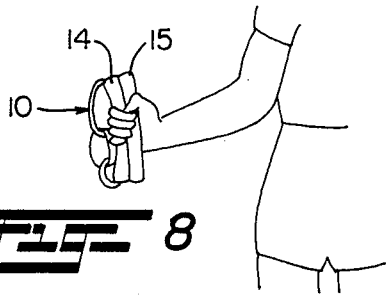

As an exercise for developing the hands and wrists, FIG. 8 illustrates the use of the exercise device 10 in performing hand squeezes by doubling the loop upon itself and grasping both handle portions 14 and 15 together in one hand. The handles are then squeezed together in the hand and, by virtue of their compressibility will assist in strengthening the hand and forearm muscles.

Figure 9:
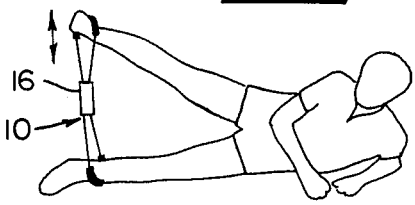

FIG. 9 illustrates use of the device in performing leg raises in which the user is positioned in a somewhat prone position on the side and performs a series of stretching exercises by progressively raising one leg with respect to the other. For this purpose, the feet are passed through individual loop portions on either side of the retainer sleeve 16 with the handle members 14 and 15 engaging the ankles. In laterally raising the upper leg away from the lower leg, those muscle groups along the insides of the legs are exercised by stretching against the resistance of the loop.

It will be evident that the exercise device 10 as described in its preferred form may be employed in numerous types of exercises, such as, those referred to commonly as the overhead butterfly, bow and arrow, frontal butterfly, arm extensions across the back, lateral chest pull and shoulder raise, side bends, back conditioner similar to sit-ups, leg presses, curls and raises, push-ups, stomach crunch and power turn. Further, as made apparent from FIG. 8, the device is characterized in particular by its ability to be folded into a compact package so as to be portable and easily transported by storing in a small compartment of a suitcase.

For the purpose of illustration but not limitation, the loop 12 is composed of a seamless natural latex tubing having a minimum tensile psi of 3,500, elongation break of 750%, shore A durometer of 35±5, and a specific gravity of 0.95.

Description of Modified Forms of FIGS. 10 to 15

Figure 10:
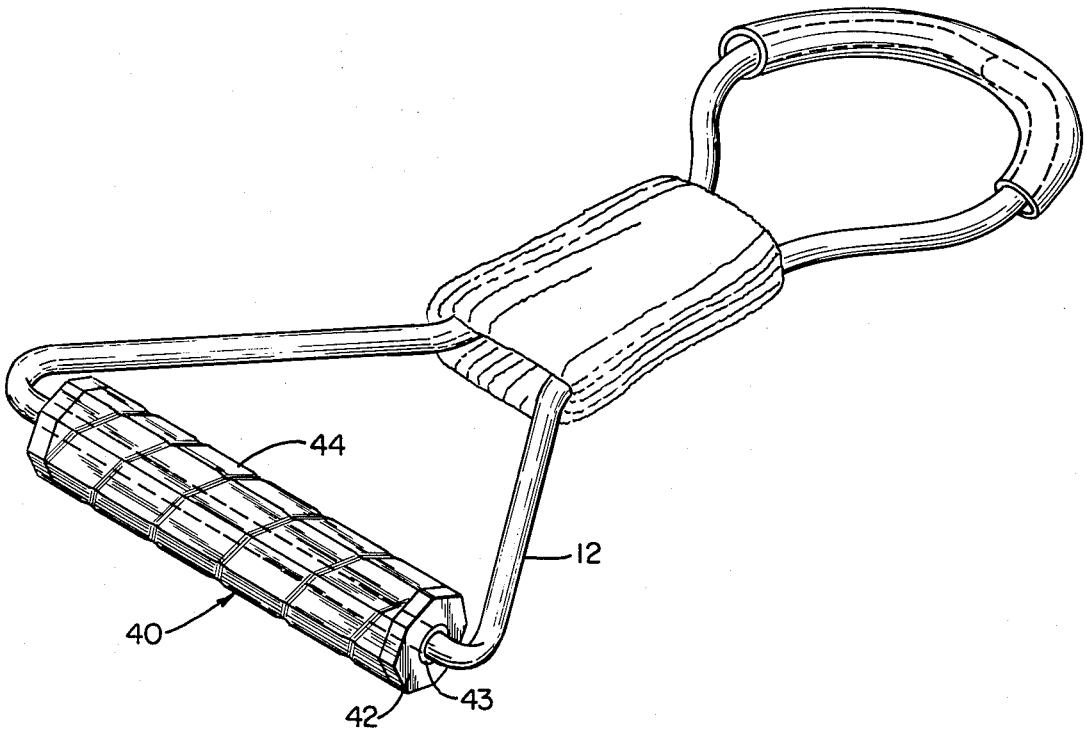
FIG. 10 is a perspective view illustrating a modified form of exercise device in which a racquet handle is employed at one end thereof.
Figure 11:
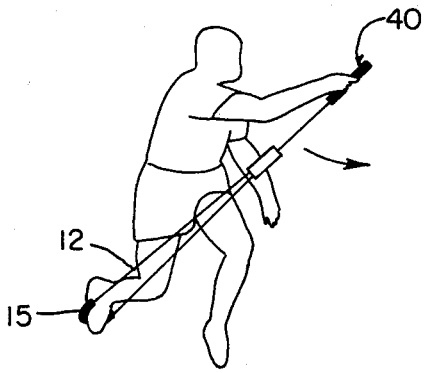
FIGS. 11 and 12 schematically illustrate execution of forehand and backhand strokes, respectively, with the modified form of invention illustrated in FIG. 10.
Figure 12:
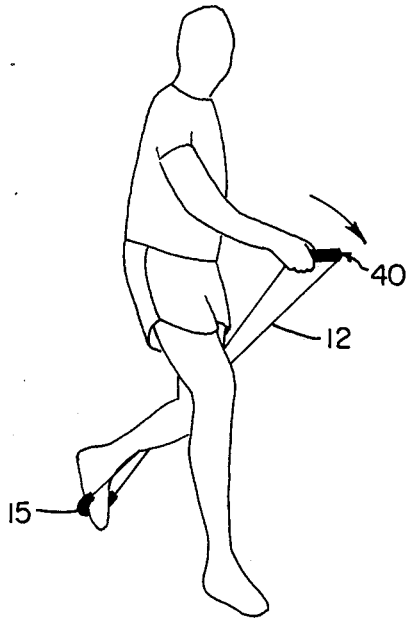

There is illustrated in FIGS. 10 to 12 a modified form of exercise device 10' in which like parts to those of the preferred form of FIGS. 1 to 9 are illustrated with corresponding numerals Specifically, the modified form of device 10' corresponds in construction and arrangement to that of the preferred form, except that one of the flexible handles 14 or 15 is replaced by a tubular or sleeve-like rigid handle 40. The handle 40 includes a generally tubular inner rigid core member 42 of a length corresponding to that of a tennis racquet handle or other standard racquet handle with a central opening 43 of a size to permit loose-fitting insertion of the loop 12. Most desirably, the core member 42 is covered with a leather wrap as indicated at 44 in a manner corresponding to that of a conventional wrap for a tennis racquet.

As illustrated in FIG. 11, the forehand stroke may be practiced by looping flexible handle 15 around the instep of the foot on the forehand side; or, in the alternative, the device may be passed behind the midsection of the body and grasped with one hand. In either case, the racquet handle 40 is then grasped in the opposite hand and the forehand stroke is simulated against the resistance of the loop 12 by stepping forward while keeping the back foot planted. The backhand stroke is performed in the same manner as the forehand stroke but with the handle portion 15 looped around the foot on the backhand side, as shown; or, once again, by passing around the midsection of the body and grasping the other end in the opposite hand.

It will be evident that practice strokes may be performed with one or both hands on the handle or grip; and the exercise is useful not only in developing that set of muscles employed in executing the stroke but in perfecting the proper form and technique for each stroke.

Figure 13:
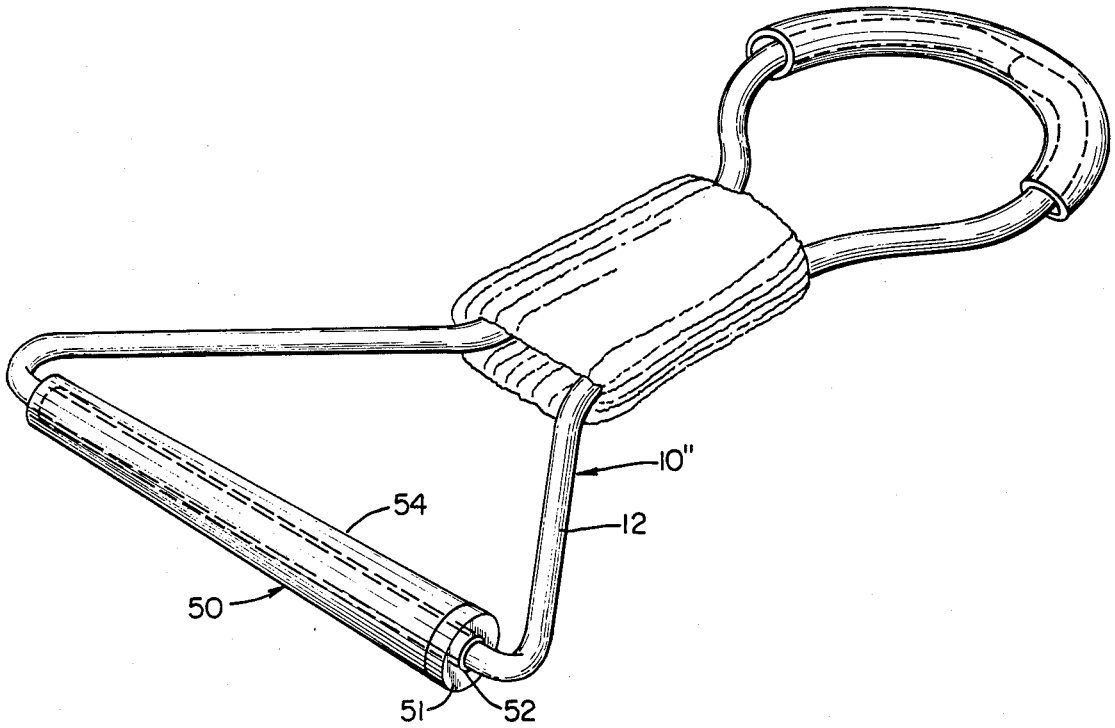
FIG. 13 illustrates another modified form of exercise device in which a golf club grip is placed at one end of the exercise device.
Figure 14:
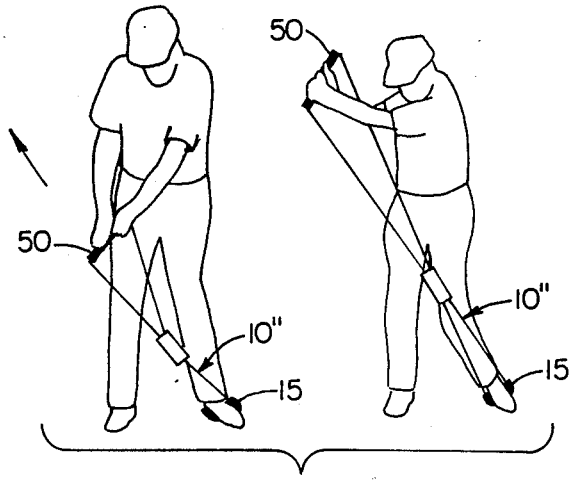
FIGS. 14 and 15 schematically illustrate simulation of the golf swing with the use of the modified form of exercise device shown in FIG. 13.

FIG. 13 illustrates another modified form of exercise device in which a golf club grip 50 is utilized in place of the racquet handle 40 at one end of the loop. The golf club grip includes a rigid tubular core member 51 having a central opening 52 sized for loose-fitting insertion of the loop 12. The core is covered with a suitable form of a grip, such as, a standard golf club grip as designated at 54 in surrounding relation to the core and firmly adhered thereto. FIG. 14 illustrates one manner of utilizing the modified form of device 10'' in practicing the backswing in golf. In this exercise, the flexible handle end 15 is looped around the front foot and the grip 50 is grasped with both hands in the same manner as grasping a golf club. The grip 50 is then drawn back and upwardly against the resistance of the loop 12 to a position comparable to that reached at the top of the backswing. As the exercise is repeated, the leg, back and arm muscles customarily employed in executing the backswing in a golf stroke are repeatedly stretched, then relaxed.

Figure 15:
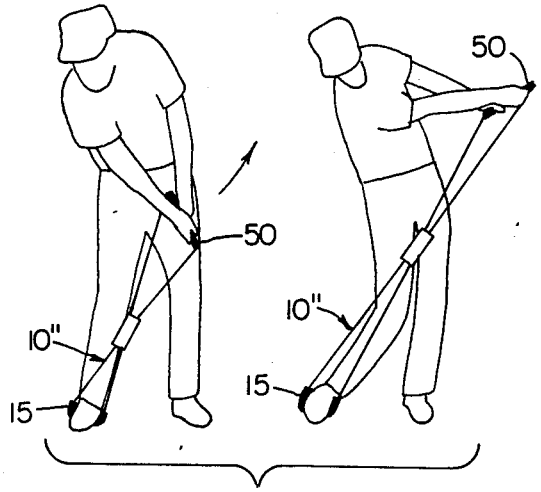

FIG. 15 illustrates use of the exercise device 10'' in practicing the downswing or follow through in a golf swing with the handle end 15 looped under the back foot and the grip end 50 being grasped in the hands as described with respect to the backswing exercise. The downswing may be practiced either as a continuation of the backswing or by starting in the position illustrated in the lefthand view of FIG. 15 and continuing through to the position shown in the righthand view.

It will be evident that exercise variations can be developed for other sports, including baseball, soccer, swimming, basketball and football. The device may be used in a wheelchair, by arthritic individuals, for example, by placing the handles on the wrist rather than gripping with the hands; and the entire workout, except push-ups, can be performed in bed.

Description of Modified Forms of FIGS. 16 to 21

In still another modified form as illustrated in FIGS. 16 and 17, a loop 60 is composed of latex rubber or other rubber or rubber-like elastomeric material and is of tubular construction. For example, it may be constructed of surgical tubing and terminates in free ends 61 and 62 which are spliced together by doubling each end upon itself and looping the ends together. An outer tubular support portion 64 encircles the spliced ends 61 and 62 and tightly constricts or compresses the looped ends together in order to prevent accidental release or separation. The tubular support 64 may be composed of a latex or polyvinyl material having limited flexibility so as to be capable of bending with the loop at the spliced end portion. A flexible handle 66 is disposed over the spliced end portions as shown, and an inflexible or rigid handle 68 is positioned in diametrically opposed relation to the handle 66, the handle 68 being in the form of a standard golf grip which, as shown in FIG. 17, has an inner core 69 suitably composed of an aluminum or other rigid metal tube and an outer surrounding rubber or rubber-like grip 70. In this regard, the golf grip 68 is of conventional construction and is contoured as illustrated to encourage proper joining of the hands together onto the grip when used in practicing the golf swing.

A band or retainer sleeve 72 is disposed in surrounding relation to intermediate portions of the loop 60 and functions in a manner similar to that described with respect to the retainer sleeve 16 of the preferred form. However, the sleeve 72 is composed of a foam plastic material of limited resiliency and of a smaller diameter than the sleeve 16 so as to more closely surround the loop portions. In this manner, the sleeve will effectively unitize the intermediate loop portions by drawing them together and preventing them from becoming unduly tangled or twisted during different exercise routines. At the same time, the sleeve will permit the intermediate portions to undergo at least limited expansion or movement of the loop portions away from one another but without directly rubbing against or chafing the skin of the exerciser.

FIGS. 18 to 20 illustrate the preferred manner of utilization of the exercise device of FIGS. 16 and 17 in which an anchor strap 74 is secured as illustrated in FIG. 18 to the flexible handle portion 66. The strap 74 is composed of a fabric or other non-stretchable material which is stitched or otherwise secured together as at 75 to form a limited opening or smaller looped end 76 and a relatively large looped end 78. The smaller looped end 76 is passed around the flexible handle and through the larger looped end 78 to secure the strap to the handle 66, and the smaller end 76 is then free to be anchored or otherwise attached to a stationary object. For example, to anchor the strap to a door, the smaller end 76 is inserted through the crack between the door D and door frame F so that when the door is closed the strap is clamped between the door D and frame F in an elevated position above the head of the golfer. As illustrated in FIG. 19, the golfer may by trial and error position himself sideways to and at the desired distance away from the door to practice the downswing against the resistance of the exercise device. The anchor strap 74 can be positioned or clamped at different locations along the door, for example, to practice arm and wrist rotation as well as to exercise the pectorals, back, triceps, and deltoid muscles.

A modified form of splice is illustrated in FIG. 21 for utilization in the preferred and modified forms of exercise devices. Again, a continuous loop 80 may be suitably composed of a latex rubber or surgical tubing and terminates in end portions 81 and 82 of a corresponding diameter. An inner tubular plug 84 is sized to be of an outer diameter slightly greater than the inner diameters of the end portions 81 and 82 and is first inserted into one end 81 so as to cause the end portion to be expanded slightly but is inserted for a distance such that it will just clear the extremity or edge 81' of the end so as to permit the edge 81' to be slightly contracted around the end of the plug. The assembled plug 84 and end portion 81 are then inserted into opposite end 82 in a manner such that the expanded end 81 and assembled plug 84 will clear the edge or extremity 82' and will be contracted somewhat around the expanded end 81. Assembly of the elements in the manner described has been found to result in an extremely secure joint without necessity of using adhesives or other foreign materials and will eliminate slipping or separation at the joint. In this form, the splice or joint is preferably covered or inserted within the retainer sleeve 42 so that any stretching forces are applied essentially along the axis of the splice. Specifically, any tension or pull applied in opposite directions away from the spliced end will tend to contract the ends 81 and 82 more tightly or firmly against the plug 84 so as to resist loosening or separation. Nevertheless the plug 84 has a limited amount of flexibility or give so as to conform to any applied bending forces applied to the spliced end portions.

For the purpose of illustration but not limitation, the outside diameter and wall thickness of the pug 84 may be on the order of 25% greater than the end portions of the loop being joined. The plug or insert 84 is made from the same material as the loop 80 and, for example, may be a latex rubber material. When assembled, a rubbing alcohol may be employed as a lubricant to facilitate insertion of the insert 84 and one end 81 with respect to the end 82. The rubbing alcohol will quickly evaporate, leaving the spliced portions of the free ends 81 and 82 securely in frictional engagement with one another and with the insert 84.

In use, an important beneficial effect of the preferred and modified forms of invention described herein is increased neuromuscular memory resulting from constant, dual resistance placed on all participating muscle groups. This triggers constant awareness of muscle activity specific to a certain skill. In addition, while the anchor strap 74 has been described specifically in connection with the modified form of golf exercise device, it is equally useful in serving as an anchor for the other forms of devices as illustrated in FIGS. 1 to 15.

Although the present invention has been described with particularity relative to the foregoing detailed description of the preferred and modified embodiments, various modifications, changes, additions and applications other than those specifically mentioned herein will be readily apparent to those having normal skill in the art without departing from the spirit and scope of this invention as defined by the appended claims.

We claim:

1. An exercise device comprising:

an elastic member in the form of an endless loop;

generally tubular handles disposed on said loop in diametrically opposed relation to one another and in surrounding relation to said loop; and retainer means in the form of an elongated protective pliable elastic sleeve surrounding intermediate portions of said endless loop to retain said intermediate portions in closely spaced relation to one another between said handles whereby said retainer means yieldingly resists separation of said intermediate portions of said loop but will not stretch lengthwise in response to grasping of said handles and stretching of said loop between said handles.

2. An exercise device according to claim 1, said endless loop having free tubular end portions, and splice means interconnecting said free end portions including a tubular insert oversized with respect to said free end portions, said insert mounted within one of said free end portions, and said insert and said one free end portion being inserted into the other of said free end portions whereby any tension applied to said free end portions causes said free end portions to contract and resist separation from said insert.

3. An exercise device according to claim 2, said endless loop being of generally tubular cross-section, one of said handles disposed in surrounding relation to said free end portions of said loop.

4. An exercise device according to claim 1, said handles being defined by hand-engaging flexible sleeves in surrounding relation to said loop.

5. An exercise device according to claim 1, said retainer means defined by an elongated, flexible terry cloth sleeve.

6. An exercise device according to claim 1, said handles and said retainer means each being in the form of sleeves, said handles disposed in surrounding relation to individual portions of said loop and said retainer means disposed in surrounding relation to diametrically opposed portions of said loop intermediately between said handles.

7. An exercise device according to claim 6, said handles each being of a greater length than the length of said retainer means and each handle composed of a material having a modulus of elasticity substantially corresponding to that of said loop.

8. An exercise device comprising:

an elastic tubular member in the form of an endless loop having free tubular end portions;

a pair of generally tubular handles disposed on said loop in diametrically opposed relation to one another and in surrounding relation to said loop, at least one of said handles being flexible;

elastic retainer means in the form of an elongated protective elastic pliable sleeve member surrounding intermediate portions of said endless loop, said retainer means being slidable with respect to said intermediate portions between said handles, said retainer means yieldingly resisting separation of said intermediate portions of said loop without lengthwise stretching in response to grasping of said handles and stretching of said loop between said handles; and splice means interconnecting said free end portions including a tubular insert oversized with respect to said free end portions, said insert mounted within one of said free end portions, and said insert and said one free end portion being inserted into the other of said free end portions whereby any tension applied to said free end portions causes said free end portions to contract and resist separation from one another.

9. An exercise device according to claim 8, said one of said handles being flexible and the other of said handles including a rigid, elongated inner core member and an outer grip in surrounding relation to said inner core member.

10. An exercise device according to claim 9, said other of said handles simulating a racquet handle that can be grasped in one or both hands and swung to simulate different racquet strokes when said one of said handles is held stationary.

11. An exercise device according to claim 9, said other of said handles simulating a golf grip which can be grasped in both hands and said one handle anchored to a stationary object whereby said grip can be swung to simulate a golf swing against the resistance of said endless loop.

12. An exercise device according to claim 9, said loop being of tubular construction having free ends spliced together and said one of said handles disposed in surrounding relation to said spliced free ends of said loop.

13. An exercise device comprising:

an elastic tubular member in the form of an endless loop;

a pair of generally tubular handles disposed on said loop in diametrically opposed relation to one another and in surrounding relation to said loop, one of said handles being flexible and the other of said handles simulating a golf grip including a rigid elongated inner core member and an outer gripping surface in surrounding relation to said inner core member that can be grasped in both hands and swung to simulate a golf swing against the resistance of said endless loop when said one handle is anchored to a stationary object; and elastic retainer means in the form of an elongated protective elastic sleeve member surrounding intermediate portions of said endless loop between said handles to yieldingly resist separation of said intermediate portions away from one another without lengthwise stretching in response to grasping of said golf grip and stretching of said loop between said golf grip and said one handle.

* * * * *